US007697857B2

(12) United States Patent
Gross et al.

(10) Patent No.: US 7,697,857 B2
(45) Date of Patent: Apr. 13, 2010

(54) MULTI-SENSOR CALIBRATION TECHNIQUE

(75) Inventors: Eric M Gross, Rochester, NY (US); Jack T Lestrange, Macedon, NY (US); Charles A Radulski, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 102 days.

(21) Appl. No.: 12/132,164

(22) Filed: Jun. 3, 2008

(65) Prior Publication Data

US 2009/0297187 A1 Dec. 3, 2009

(51) Int. Cl.
*G03G 15/00* (2006.01)

(52) U.S. Cl. ..... 399/49; 399/66

(58) Field of Classification Search ..... 399/9, 399/49, 66, 74, 297

See application file for complete search history.

(56) References Cited

U.S. PATENT DOCUMENTS 5,294,959 A * 3/1994 Nagao et al. ..... 399/66 X
5,307,119 A * 4/1994 Folkins et al. ..... 399/74 X
5,543,896 A 8/1996 Mestha
5,887,221 A 3/1999 Grace
5,903,797 A 5/1999 Daniels et al.
6,272,295 B1 8/2001 Lindblad et al.
2005/0196187 A1 * 9/2005 Mizes et al. ..... 399/49
2006/0222388 A1 * 10/2006 DiRubio et al. ..... 399/49
2006/0285864 A1 * 12/2006 Hattori ..... 399/49
2007/0048021 A1 * 3/2007 Hirobe et al. ..... 399/223
2008/0069579 A1 * 3/2008 Tabata et al. ..... 399/53
2008/0138121 A1 * 6/2008 Tamaki ..... 399/302

* cited by examiner

*Primary Examiner*—Sophia S Chen

(57) ABSTRACT

A method and apparatus for sensor calibration to obtain transfer efficiency measurements in a reprographic device from a pair of optical toner mass sensors, one located before and one located after transfer. Individual sensors differ (mounting variation, electrical component variation, etc.) in their response to a common sample. Because of low mass levels in transfer efficiency measurements it is essential to reduce sensor to sensor differences. Disclosed is a method of calibrating the sensors to each other by utilizing each sensor's response to at least two identical mass levels. Actual mass levels do not need to be known (except for the zero mass which is easy to ensure) and the individual sensor sensitivities do not need to be known since the ratio of responses yields the necessary sensor characterization. This method does not require unique calibrations among sensors and results in a more accurate and precise measurement of transfer efficiency.

14 Claims, 2 Drawing Sheets

MULTI-SENSOR CALIBRATION TECHNIQUE

Figure 1:
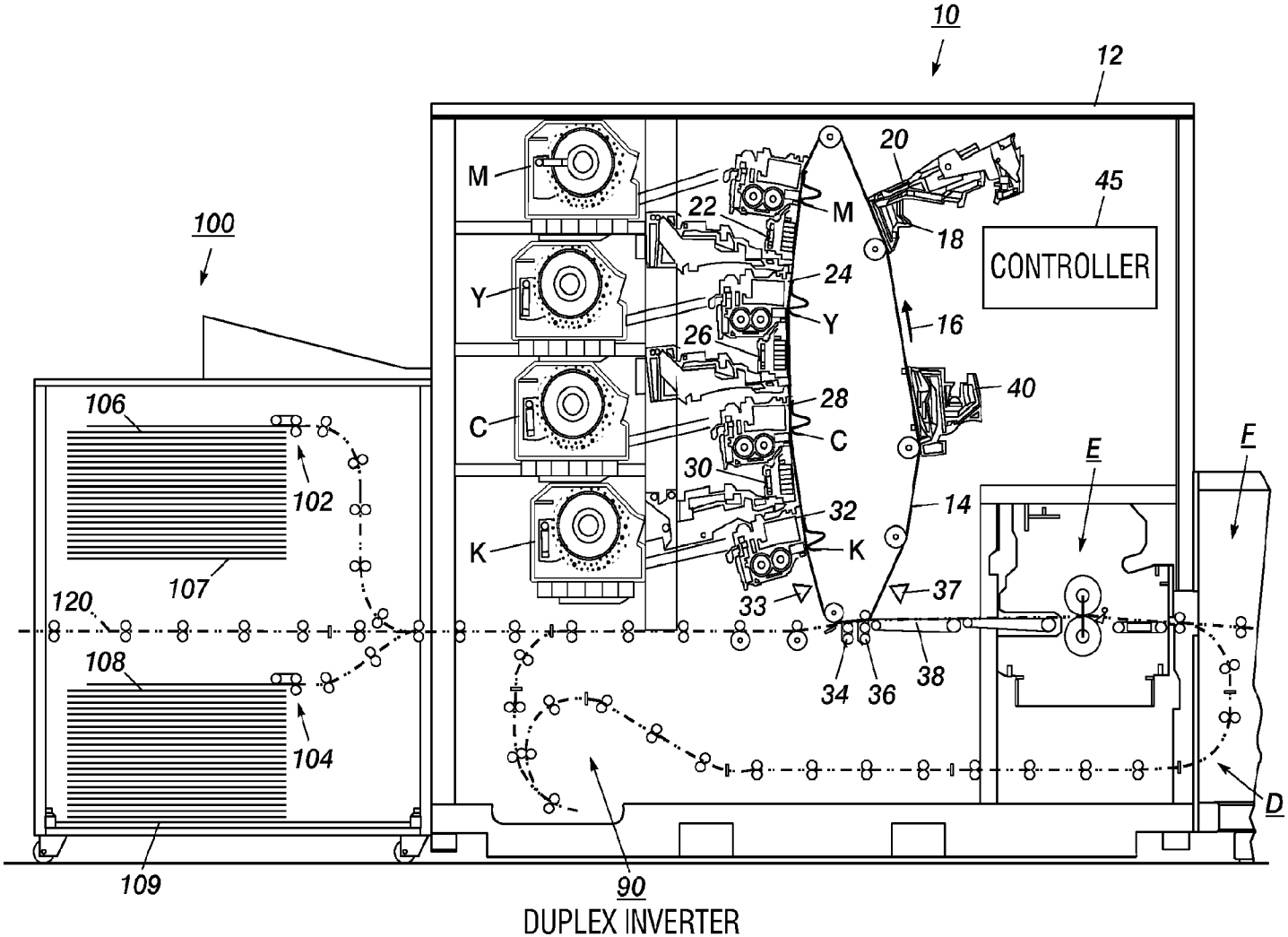

This invention relates in general to an image forming apparatus, and more particularly, to an image forming apparatus employing a reflective sensor calibration technique that includes automatic compensation for sensor to sensor differences.

Xerographic transfer system performance is often a limiting factor in image quality and media latitude. Whether in set-up, diagnostic mode, or real time feedback, the measurement of transfer efficiency can be a key indicator of the system state and can provide a feedback signal for system adjustment and/or maintenance. Unfortunately, to measure transfer efficiency a mass sensor prior to transfer and a mass sensor post transfer is required. Improper calibration of the sensors can lead to serious measurement inaccuracies. Complicating this matter is that sensor recalibrations are frequently required due to photoreceptor reflectivity changes and sensor incident light intensity drift.

In part because of such difficulties, transfer efficiency measurements have not been embedded into products, but instead have been confined to lab environments. However, even in the lab, time consuming and lengthy mass to reflective sensor calibrations involving mass collection measurements have to be performed.

As disclosed in U.S. Pat. No. 5,887,221 and U.S. Pat. No. 5,543,896, the use of sensors in a xerographic engine to detect the toner mass levels on a photoreceptor, or other substrate, in a post-development position (detection of developed mass) is known. The use of sensors to detect residual toner mass levels post-cleaning device is also described in U.S. Pat. No. 6,272,295 and U.S. Pat. No. 5,903,797. It is also known to measure the residual mass after transfer, but before the cleaning device (post-transfer residual mass).

Previous post-transfer residual mass sensors provided information about the average transfer efficiency and could enable limited closed loop control of xerographic transfer system. For example, use of an Extended Toner Area Coverage (ETAC) sensor to measure residual mass during xerographic set-up. The data from an ETAC sensor was used to adjust a transfer process current set point or other parameter, to obtain optimal performance prior to the submission of a customer's job.

While discourses of the above-mentioned patents are useful, there is still a need to improve sensor calibration in order to enhance transfer efficiency measurement and thereby system performance.

Accordingly, a method is disclosed for sensor calibration and signal processing to obtain transfer efficiency measurements for a pair of ETAC sensors, one located before transfer and the other located after transfer. The same mass is passed under both sensors and the ratio of responses yields the necessary sensor characterization. The actual mass levels are not required. It is applicable to the diffuse light reflective sensor, since there is substantially more signal to noise at higher mass levels in comparison to the specular channel and mass varies linearly with diffuse reflectance over the range of interest. In addition, it is often at higher mass levels (two layer or three layer patches) that transfer efficiency information is most often needed. Thus, providing a clear advantage in simplicity compared to methods that require mass collection measurements of a predetermined mass to sensor response curve.

The disclosed reprographic system that incorporates the disclosed improved method for measuring transfer efficiency for control, diagnostics and/or set-up may be operated by and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposes or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Figure 2:
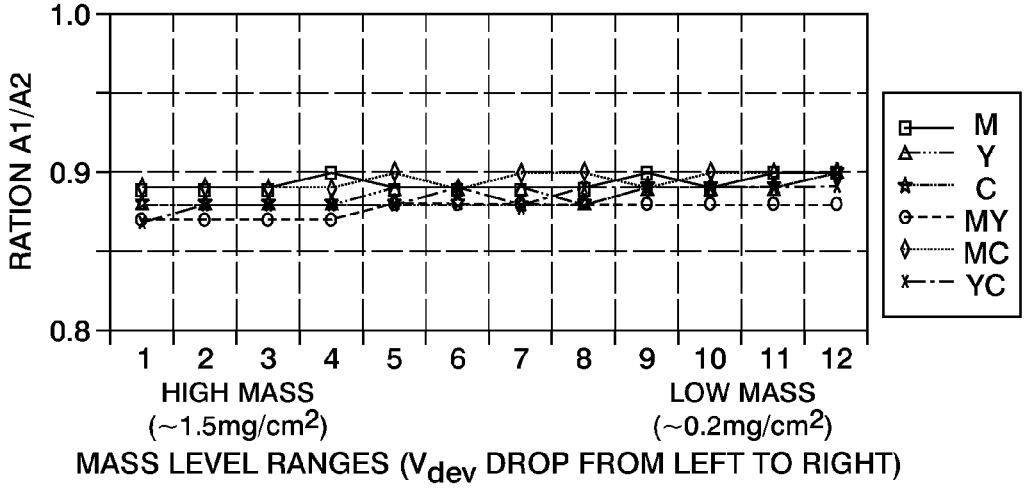
Figure 3:
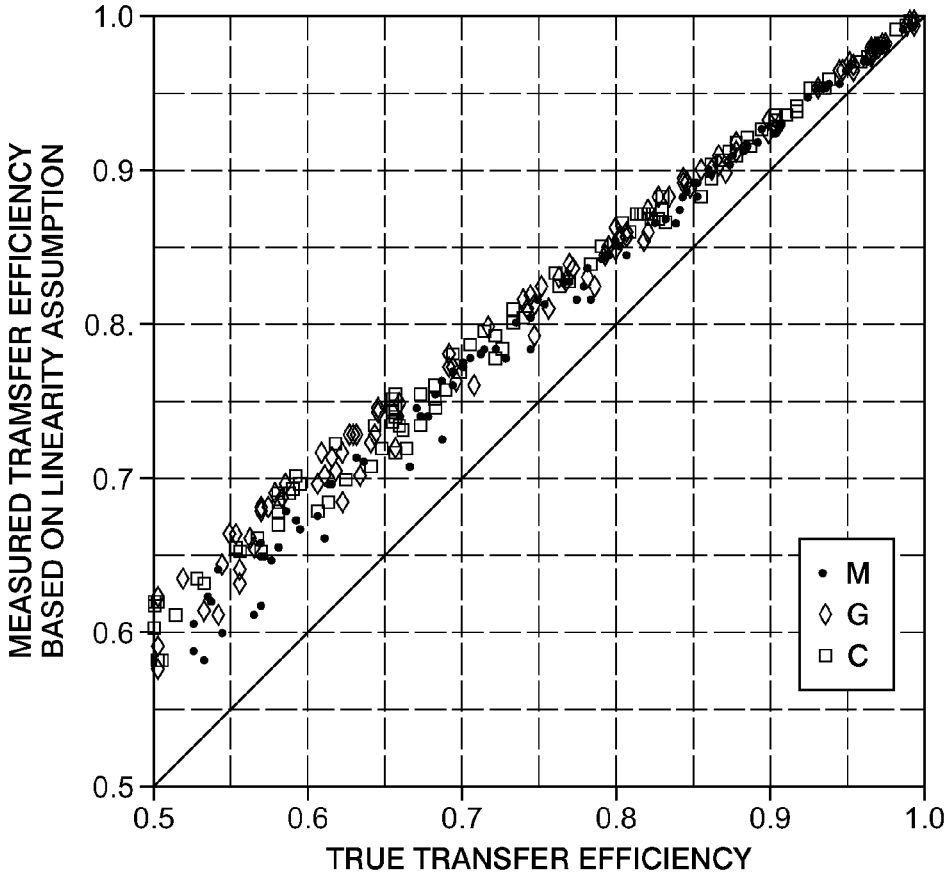

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

FIG. 1 is a partial, frontal view of an exemplary modular xerographic printer that includes the transfer efficiency measurement technique of the present disclosure;

FIG. 2 graph showing ratio estimates vs. mass level resulting from a development sweep; and FIG. 3 is a graph showing simulated measured transfer efficiency base on linearity assumption against a simulated true transfer efficiency which is slightly linear.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes a method and apparatus for sensor calibration and processing to obtain transfer efficiency measurements.

For a general understanding of the features of the disclosure, reference is made to the drawings. In the drawings, like reference numerals have been used throughout to identify identical elements.

Referring now to printer 10 in the figure, as in other xerographic machines, and as is well known, shows an electrographic printing system including the improved method and apparatus for feeding multiple types of paper and printing jobs from a paper feed tray embodiment of the present disclosure. The term "printing system" as used here encompasses a printer apparatus, including any associated peripheral or modular devices, where the term "printer" as used herein encompasses any apparatus, such as a digital copier, bookmaking machine, facsimile machine, multifunction machine, et., which performs a print outputting function for any purpose. Marking module 12 includes a charge retentive substrate which could be a photoreceptor belt 14 that advances in the direction of arrow 16 through the various processing stations around the path of belt 14. Charger 18 charges an area of belt 14 to a relatively high, substantially uniform potential. Next, the charged area of belt 14 passes laser 20 to expose selected areas of belt 14 to a pattern of light, to discharge selected areas to produce an electrostatic latent image. Next, the illuminated area of the belt passes developer unit M, which deposits magenta toner on charged areas of the belt.

Subsequently, charger 22 charges the area of belt 14 to a relatively high, substantially uniform potential. Next, the charged area of belt 14 passes laser 24 to expose selected areas of belt 14 to a pattern of light, to discharge selected areas to produce an electrostatic latent image. Next, the illuminated area of the belt passes developer unit Y, which deposits yellow toner on charged areas of the belt.

Subsequently, charger 26 charges the area of belt 14 to a relatively high, substantially uniform potential. Next, the charged area of belt 14 passes laser 28 to expose selected areas of belt 14 to a pattern of light, to discharge selected areas to produce an electrostatic latent image. Next, the illuminated area of the belt passes developer unit C, which deposits cyan toner on charged areas of the belt.

Subsequently, charger 30 charges the area of belt 14 to a relatively high, substantially uniform potential. Next, the charged area of belt 14 passes laser 32 to expose selected areas of belt 14 to a pattern of light, to discharge selected areas to produce an electrostatic latent image. Next, the illuminated area of the belt passes developer unit K, which deposits black toner on charged areas of the belt.

As a result of the processing described above, a full color toner image is now moving on belt 14. In synchronism with the movement of the image on belt 14, a conventional registration system receives copy sheets from sheet feeder module 100 and brings the copy sheets into contact with the image on belt 14. Sheet feeder module 100 includes high capacity feeders 102 and 104 that feed sheets from sheet stacks 106 and 108 positioned on media supply trays 107 and 109 and directs them along sheet path 120 to imaging or marking module 112. Additional high capacity media trays could be added to feed sheets along sheet path 120, if desired.

A corotron 34 charges a sheet to tack the sheet to belt 14 and to move the toner from belt 14 to the sheet. Subsequently, detack corotron 36 charges the sheet to an opposite polarity to detack the sheet from belt 14. Prefuser transport 38 moves the sheet to fuser E, which permanently affixes the toner to the sheet with heat and pressure. The sheet then advances to stacker module F, or to duplex loop D.

Cleaner 40 removes toner that may remain on the image area of belt 14. In order to complete duplex copying, duplex loop D feeds sheets back for transfer of a toner powder image to the opposed sides of the sheets. Duplex inverter 90, in duplex loop D, inverts the sheet such that what was the top face of the sheet, on the previous pass through transfer, will be the bottom face on the sheet, on the next pass through transfer. Duplex inverter 90 inverts each sheet such that what was the leading edge of the sheet, on the previous pass through transfer, will be the trailing on the sheet, on the next pass through transfer.

With further reference to FIG. 1 and in accordance with the present disclosure, a simple method and apparatus for sensor calibration and processing to obtain transfer efficiency measurements is shown that includes an algorithm and pre-transfer and post-transfer reflective sensors for recording diffuse reflected light from a patch developed on drum or belt photoreceptor substrate 14. As shown, the pre-transfer sensor 33 and post-transfer sensor 37 are conventional ETAC sensors, however, post-transfer sensor 37 could be a full width array sensor, if desired. They both are used to send signals back to controller 45. For tandem systems, to measure transfer efficiency at the second transfer, there can also be sensors situated at pre and post second transfer and observing patches on the intermediate transfer belt. Utilizing the routine way in which substrate variation is removed, diffuse clean belt reads are obtained as a function of belt position. The diffuse response is well approximated as linear with respect to mass for the purposes here. This is a good approximation up to ~1 $mg/cm^2$. After that level, the signal begins to roll off. Nonetheless, this assumption is made and validity assessed via simulation based on experimentally obtained diffuse channel signal to mass roll off.

The algorithm for increasing transfer efficiency that follows does not apply to black since the diffuse signal does not respond to mass changes for black toner. It is applicable, however, to a wide set of single, two layer, and three layer patches, such as, M, Y, C, MY, MC, YC, and MYC. In practice, at various contone mass levels (precise values do not need to be known, just a developer sweep, for example), diffuse reads are recorded (with transfer current off) so each ETAC sees the same mass. It follows that if two different sensors at two different locations are measuring the same mass at the same point on the belt (measurements separated in time due to belt transport), then:

$$V\text{diff_1}=A_1*\text{mass}+B_1 \text{ (sensor 33)}$$

$$V\text{idff_2}=A_2*\text{mass}+B_2 \text{ (sensor 37)}$$

B_1 and B_2 are easily measured by ensuring that the substrate 14 is cleaned of any residual mass, i.e. mass=0. Do a development sweep and record resulting reads by mass level (actual masses do not need to be known). In principle only a clean belt (0 mass) and another unknown but different mass level is required. In the case of only one mass level, mass_1, then measuring these produces:

$$V\text{diff_1}=A_1*\text{mass_1}+B_1$$

$$V\text{idff_2}=A_2*\text{mass_1}+B_2$$

$$(V\text{diff_1}-B_1)/(V\text{diff_2}-B_2)=(A_1*\text{mass_1})/(A_2*\text{mass_1})=A_1/A_2$$

The unknown mass level, mass_1, cancels out. The ratio A_1/A_2 above can be computed for a range of non-zero mass levels and the same ratio should result in all cases (assuming the linearity approximation holds). This algorithm has now identified estimates for B_1, B_2, and A_1/A_2. Prior to transfer an input mass at some level passes under the ETAC 33 and we obtain:

$$V\text{diff_1}=A_1*\text{mass_input}+B_1$$

Post transfer an output mass at some level passes under the second ETAC 37 and we obtain:

$$V\text{diff_2}=A_2*\text{mass_output}+B_2$$

Transfer efficiency is defined as:

$$1-\text{mass_output}/\text{mass_input}.$$

Therefore, we compute:

1−(Vdiff_2−B_2)/(Vdiff_1−B_1)*A1/A2=1−mass_output/mass_input. As a result, the transfer efficiency is computed from all terms that are known. No mass collection or actual mass measurements are required.

The graph of FIG. 2 shows the results of a development sweep from a test fixture similar to the printer of FIG. 1. Computed ratios A_1/A_2 appear constant over a wide range of patches and colors. The variation that does exist, when propagated to transfer efficiencies at set points of interest, is negligible. This supports the linearity assumption as being appropriate.

Simulated measured transfer efficiency is shown in the graph of FIG. 3 based on linearity assumption against simulated true transfer efficiency (based on extensive mass collection measurements) when a $2^{nd}$ order mass to diffuse voltage fit is assumed correct over a portion of the curve. The $2^{nd}$ order mass to diffuse voltage fit is obtained from ETAC mass calibration data. Magenta, Yellow and Cyan are compiled.

From FIG. 3, the bias in the estimate increases at lower transfer efficiency levels. For example, a true 85% transfer efficiency corresponds to 88% based on the present disclosure. Bias appears to be possibly independent of ETAC, but may differ considerably given toner and hardware differences.

In recapitulation, a method and apparatus has been disclosed for sensor calibration and processing to obtain transfer efficiency measurements. The same mass is passed under pre-transfer and post-transfer sensors and the ratio of each response yields the necessary sensor characterization.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A multi-sensor calibration method for obtaining improved accuracy of transfer efficiency measurements in a reprographic device, comprising:

providing a charge retentive surface;

providing a patch on said charge retentive surface;

placing toner mass onto said patch;

developing said toner mass;

providing a transfer subsystem for transferring toner from said charge retentive surface to a media surface;

providing a sensor to sensor calibration update routine that includes an algorithm that reduces sensor to sensor response differences among a first sensor for sensing said toner mass on said patch before reaching a transfer station of said transfer subsystem and a second sensor for sensing said toner mass on said patch, after passing said transfer station, and wherein said calibration algorithm identifies a ratio of sensitivities of each sensor by utilizing the passing of said developed toner mass under each sensor and recording the response while simultaneously disabling said transfer subsystem during said sensor to sensor calibration update routine; and using output signals from said first and second sensors, in addition to said ratio of sensitivities of each sensor and each sensor's response to a zero mass condition (clean belt) to compute a ratio transfer efficiency measurement.

2. The method of claim 1, wherein said charge retentive surface is a photoreceptor.

3. The method of claim 2, wherein said photoreceptor is a belt.

4. The method of claim 2, further providing a full width array as said second sensor.

5. The method of claim 2, wherein said first and second sensors are diffuse light optical reflective sensors.

6. The method of claim 5, further providing multiple layers of toner on said patch.

7. The method of claim 1, further providing cleaning said charge retentive surface before placing a toner mass onto said patch.

8. A reprographic device, comprising:

a controller that receives an image signal representing an image to be printed;

a photoconductive surface;

a charging station that charges the photoconductive surface to a relatively high potential;

an exposure station that receives image signals from the controller and records an electrostatic latent image on the photoconductive surface;

a development station that deposits toner over the electrostatic latent image on the photoconductive surface to form a toner image;

a transfer station that transfers the toner image from the photoconductive surface to a recording medium;

a patch on said photoconductive surface for receiving a toner mass thereon;

a first sensor for sensing said toner mass on said patch before reaching the transfer station; and a second sensor for sensing said toner mass on said patch, after passing the transfer station, and wherein said controller uses output signals from said first and second sensors to compute transfer efficiency by utilizing a calibration phase that includes a sensor to sensor calibration algorithm which reduces sensor to sensor response differences among said first sensor for sensing said toner mass on said patch before reaching said transfer station and said second sensor for sensing said toner mass on said patch after passing said transfer station, and wherein said calibration algorithm identifies a ratio of sensitivities of each sensor by passing said toner mass under each sensor and recording a response while simultaneously disabling said transfer station during the sensor to sensor calibration phase.

9. The reprographic device of claim 8, wherein said photoconductive surface is a photoreceptor.

10. The reprographic device of claim 9, wherein said photoreceptor is a belt.

11. The method reprographic device of claim 8, wherein said second sensor is a full width array.

12. The reprographic device of claim 8, wherein said first and second sensors are diffuse light optical reflective sensors.

13. The reprographic device of claim 12, wherein said patch includes multiple layers of toner.

14. The reprographic device of claim 8, wherein said photoconductive surface is cleaned before a toner mass is placed onto said patch.

* * * * *